US006315376B1

(12) United States Patent
Wiseman

(10) Patent No.: US 6,315,376 B1
(45) Date of Patent: Nov. 13, 2001

(54) UNIVERSAL TOOL TRANSPORT CART

(76) Inventor: Raymond E. Wiseman, 5325-113th Pl. NE., Apt. 64, Kirkland, WA (US) 98033

( * ) Notice: Subject to any disclaimer, the term of this patent is extended or adjusted under 35 U.S.C. 154(b) by 0 days.

(21) Appl. No.: 09/541,778

(22) Filed: Apr. 3, 2000

(51) Int. Cl.[7] ..... A47B 46/00
(52) U.S. Cl. ..... 312/249.8; 312/279; 144/285
(58) Field of Search ..... 312/249.8, 249.13, 312/237, 198, 308, 278, 279; 144/285, 286.1, 286.5, 287; 206/372, 373

(56) References Cited

U.S. PATENT DOCUMENTS

| | | | | |
|---|---|---|---|---|
| D. 337,404 | | 7/1993 | Miles . | |
| 2,525,208 | | 10/1950 | Clink . | |
| 2,610,761 | * | 9/1952 | Fleming | 144/285 X |
| 2,636,526 | * | 4/1953 | Madden | 144/286.1 |
| 2,903,316 | * | 9/1959 | Schmidt | 312/279 X |
| 4,055,206 | * | 10/1977 | Griffin | 144/285 |
| 4,070,075 | * | 1/1978 | Morgan | 312/249.13 |
| 4,733,703 | | 3/1988 | Cimino . | |
| 4,735,245 | * | 4/1988 | Cox | 144/286.1 X |
| 5,255,724 | * | 10/1993 | Butke | 144/286.5 X |
| 5,423,651 | * | 6/1995 | Dinverno | 312/249.8 X |
| 5,482,162 | | 1/1996 | Dickinson . | |
| 5,497,878 | | 3/1996 | Sandonato . | |
| 5,577,817 | * | 11/1996 | Reynolds | 312/249.8 X |
| 5,725,037 | | 3/1998 | Faulhaber . | |
| 5,997,116 | * | 12/1999 | Schmidt | 206/373 X |

* cited by examiner

*Primary Examiner*—Peter M. Cuomo
*Assistant Examiner*—Hanh V. Tran
(74) *Attorney, Agent, or Firm*—Dean A. Craine

(57) ABSTRACT

A universal tool transport cart for large workbench tools, hand tools, work supplies, safety equipment, and miscellaneous accessories that is mounted on wheels for easy movement around a shop area. More particularly, the cart includes a lower base unit mounted on four caster wheels. The base unit includes two opposite end storage areas, a central storage area, and a flat top surface. Attached to the top surface of the base unit is a trapezoidal unit designed to hold various workbench tools, such as a band saw, a jointer, sander, and the like. The trapezoidal unit is shorter in length than the base unit thereby enabling one end of the base unit's top surface to be used as a horizontal workbench. The front and rear end openings are formed into the trapezoidal unit enable elongated tools and machine accessories to be stored longitudinally under the trapezoidal unit and over the top surface of the base unit.

14 Claims, 5 Drawing Sheets

UNIVERSAL TOOL TRANSPORT CART

BACKGROUND OF THE INVENTION

1. Field of the Invention

The following invention pertains to tool transport carts and, more particularly, to such carts that can be used with large workbench tools that can be operated while attached to the transport cart.

2. Description of the Related Art

Trades people and do-it-yourselfers often work in workshops with a wide variety of different tools. Unfortunately, there often isn't sufficient workbench space to keep all of the tools assembled and ready to operate. While the larger workbench tools may be permanently setup on workbenches, smaller workbench tools, hand tools, and the accessories used with these tools are usually stored on shelves or racks.

Today, there are several multi-purpose shop tools available for woodworking and metalworking. Such multi-purpose tools are three-in-one tools that share common components, such as a workbench or electric motor, which can be easily configured to operate as a lathe, mill, saw, and a drill. Their main advantages are that their tools can be conveniently stored in a ready-to-use manner, and occupy less shop space than four separate tools. Their main disadvantage is that the tools are designed to use shared components, which enables the manufacturer to demand a high retail price and control replacement parts and accessories.

What is needed is a relatively inexpensive, universal tool transport cart that enables a plurality of workbench tools to be conveniently stored in a ready-to-use manner.

SUMMARY OF THE INVENTION

It is an object of the present invention to provide a tool transport cart for a plurality of workbench tools.

It is another object of the present invention to provide such a cart that is relatively inexpensive to manufacture.

It is another object of the present invention to provide such a cart that includes additional storage space of work pieces, work supplies, small hand tools, safety equipment, and miscellaneous accessories.

These and other objects are met by a universal tool transport cart for large workbench tools, small hand tools, work supplies, safety equipment, and machinery accessories that is mounted on wheels to be easily rolled around a shop area. More particularly, the storage unit includes a lower base unit mounted on four caster wheels. The base unit includes two opposite end storage areas, a relatively large central storage area, and a flat top surface.

Attached to the top surface of the base unit is an elongated, trapezoidal unit designed to hold various large workbench tools, such as a band saw, a jointer, sander, and the like. The trapezoidal unit is shorter in length than the base unit thereby enabling one end of the top surface to be exposed and used as a horizontal workbench. Holes are formed in the exposed top surface of the base unit that enable another workbench tool, such as a scroll saw, to be attached. The trapezoidal unit includes a flat top surface, two diagonally aligned side surfaces, and two end openings. The flat top surface may be used to support a large workbench tool, such as a band saw. The two diagonally aligned side surfaces may be used to attach smaller workbench tools, such as a jointer or belt sander. The end openings enable elongated tools, work pieces and machine accessories to be stored longitudinally under the trapezoidal unit and over the top surface of the base unit. In the preferred embodiment, the diagonally aligned side surfaces are pivotally mounted to the trapezoidal unit thereby enabling the workbench tools mounted thereon to be used in a diagonally or vertically aligned positions.

DESCRIPTION OF THE PREFERRED EMBODIMENT(S)

Figure 1:
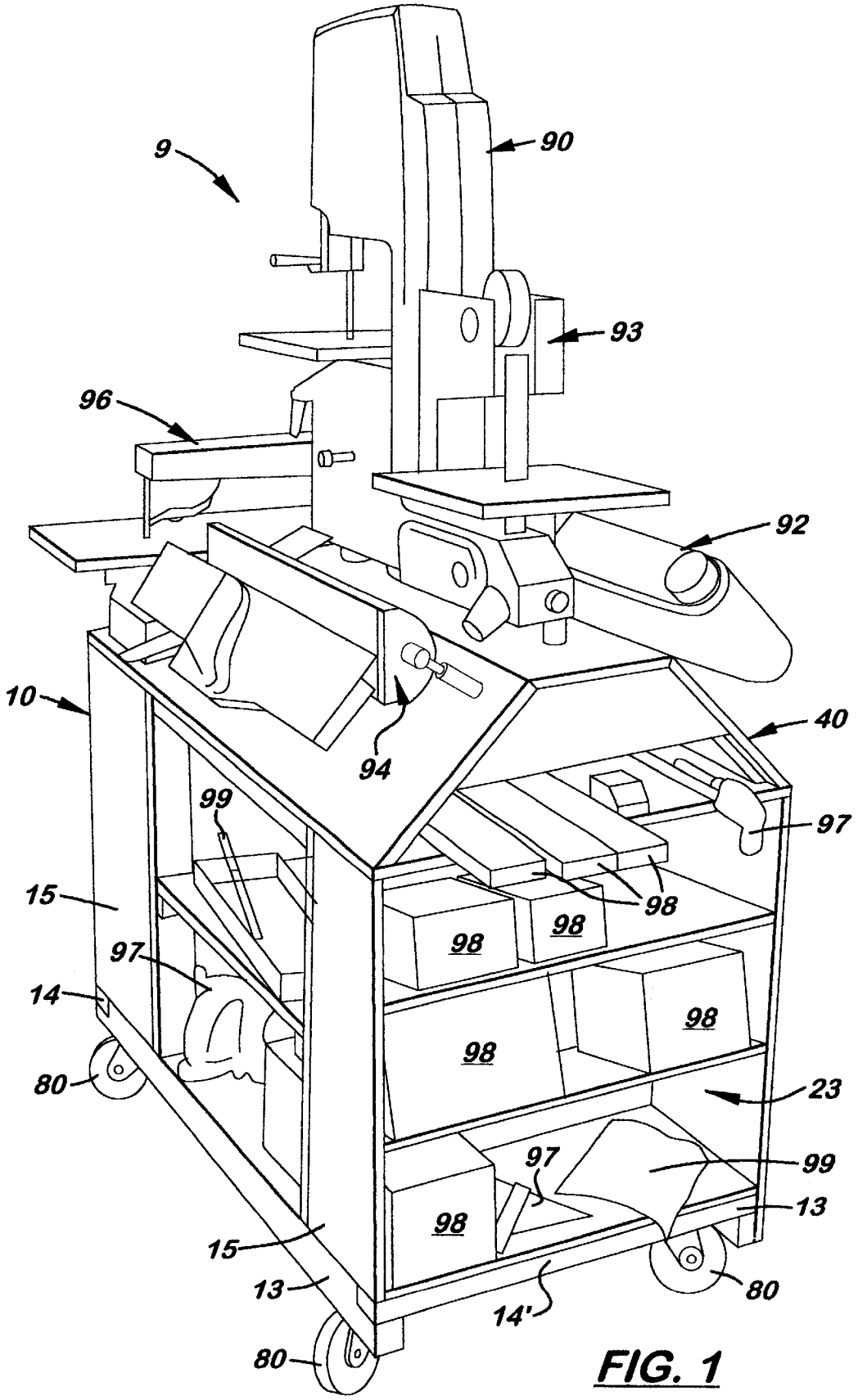
FIG. 1 is perspective view of the universal tool transport cart shown with a plurality of workbench tools, hand tools, work supplies, and safety equipment stored thereon.
Figure 2:
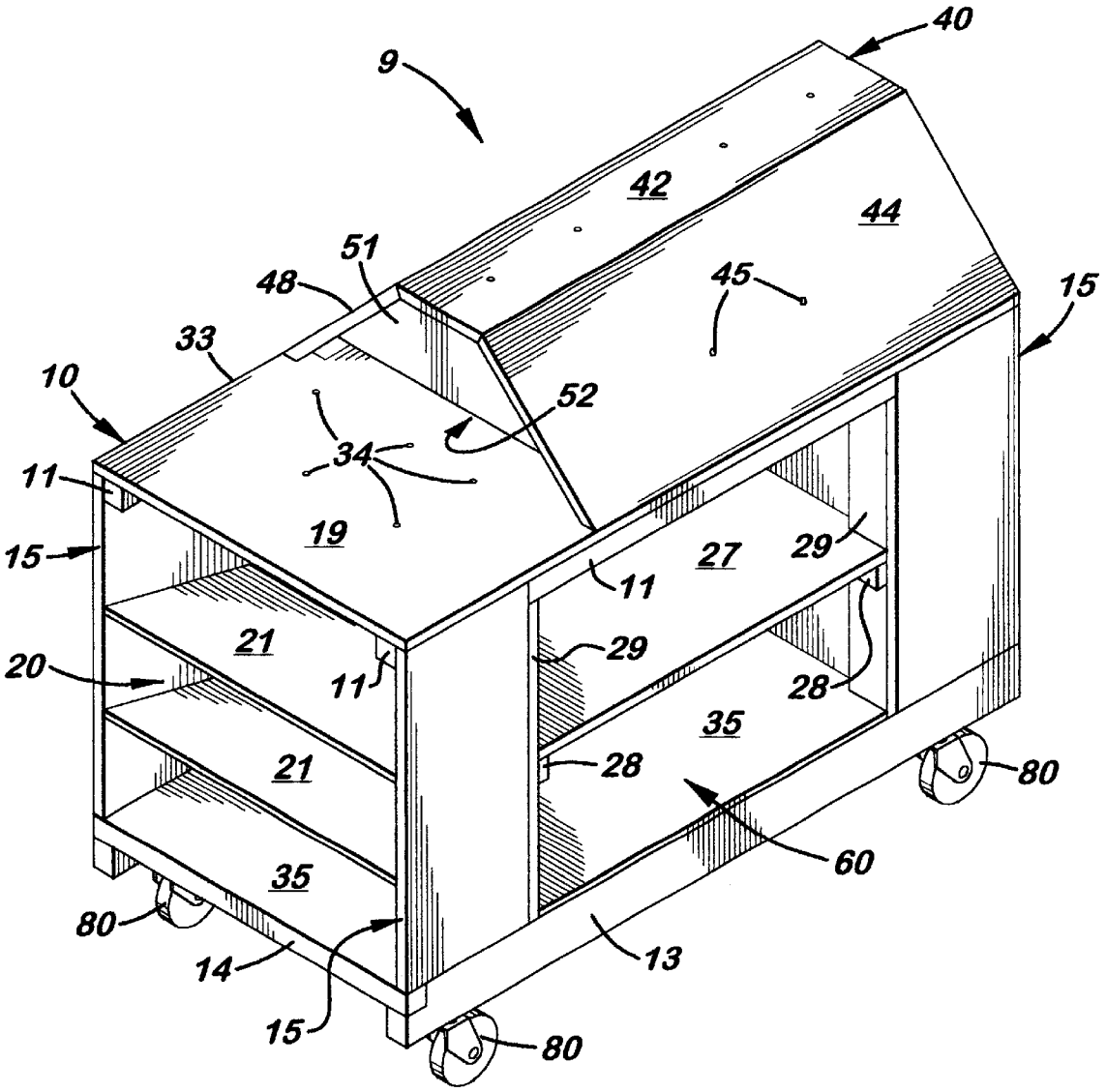
FIG. 2 is a perspective view of the universal tool transport cart shown with the workbench tool work supplies, and hand tools removed therefrom.
Figure 3:
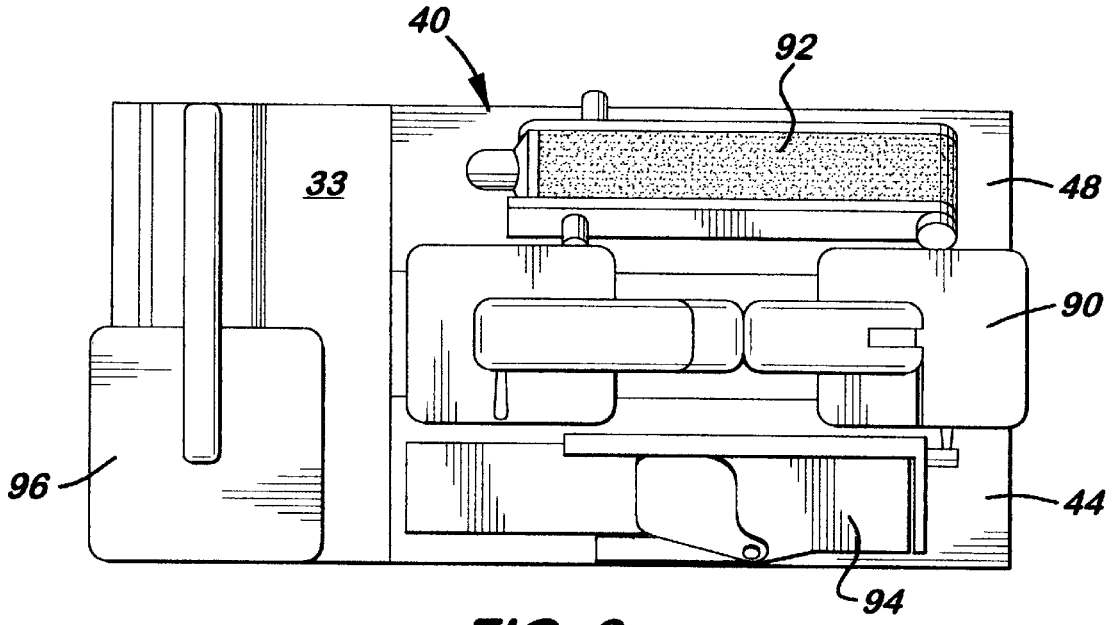
FIG. 3 is a top plan view of the transport cart shown in FIG. 1
Figure 4:
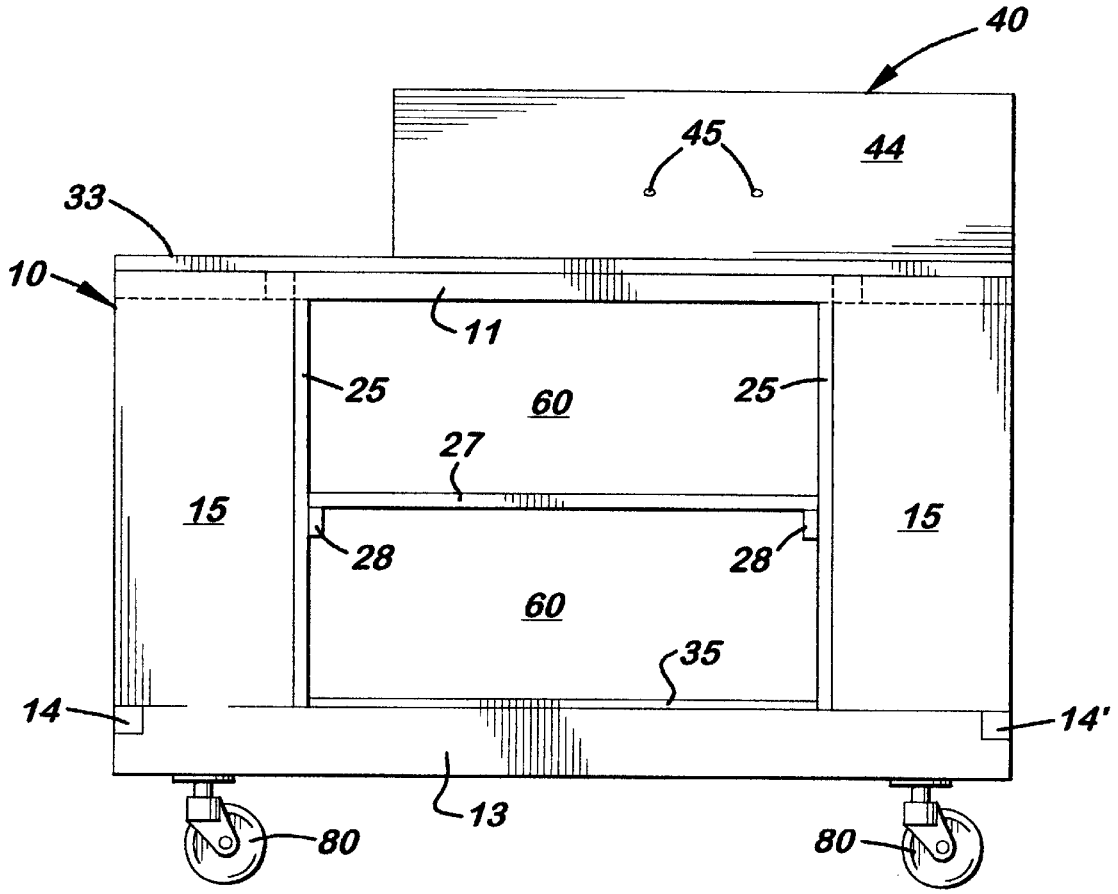
FIG. 4 is a right side elevation view of the transport cart shown in FIG. 2.
Figure 5:
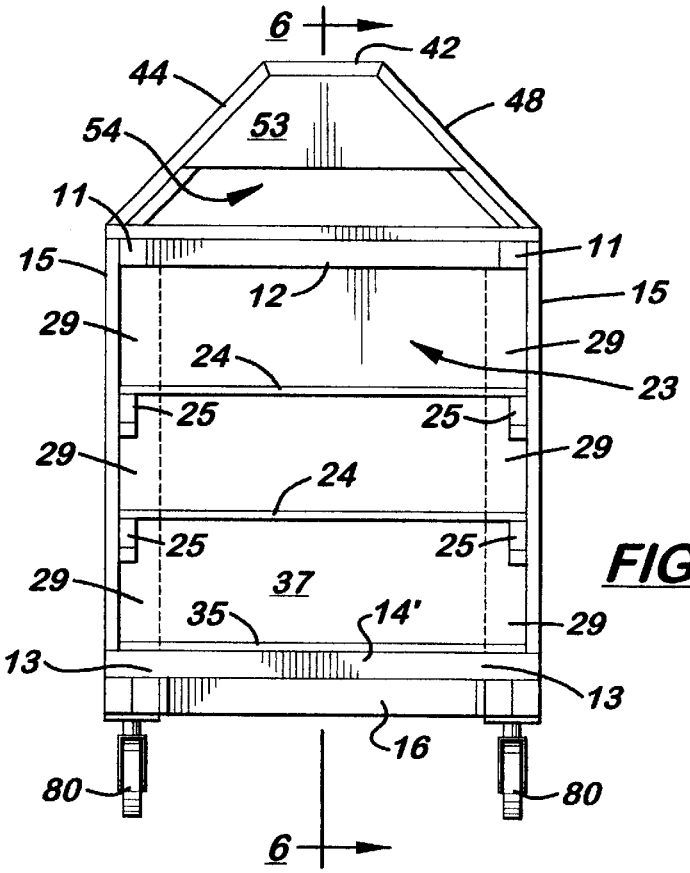
FIG. 5 is a rear elevation view of the transport cart shown in FIGS. 1 and 4.

Shown in the accompanying FIGS. 1–7 is a universal tool transport cart generally denoted 9, for workbench tools 90, 92, 93, 94, 96, hand tools 97, work pieces 98 and miscellaneous accessories 99 that is mounted on caster wheels 80 for easy movement around a shop area. More particularly, the cart 9 includes a lower base unit 10 mounted on four caster wheels 80 and an upper trapezoidal unit 40 located on the base unit 10. The base unit 10 that includes two opposite end storage areas, 20, 23, and a central storage area 60. The trapezoidal unit 40 is designed to hold various workbench tools, such as a band saw 90, a sander 92, strip sander 93, jointer 94, and the like, in assembled, ready-to-use positions. The trapezoidal unit 40 is shorter in length than the base unit 10 thereby enabling one end of the top surface 19 to be used as a horizontal workbench. Holes 34 are formed in the top surface 19 that enable a workbench tool, such as a scroll saw 96, to be attached.

In the embodiment shown in the accompanying Figs., the base unit 10 is a rectangular-shaped cart including a horizontal top panel 33, a horizontal bottom panel 35, four vertical side panels 15, two parallel longitudinally aligned top rails 11, two longitudinally aligned bottom rails 13, and two transversely aligned bottom cross rails 14. Formed between the two side panels 15 on one end is a front storage area 20. The front storage area 20 contains two optional shelves 21. The shelves 21 are supported by shelf supports 22 connected to the inside surface of the vertical side panels 15. The shelves 21 are slanted upward toward the front to prevent items stored on the shelves 21 from falling out when the cart 9 is bumped or suddenly stopped. Located inside the front end storage area 20 and behind the shelves 21 is a vertical and transversely aligned back panel member 37.

Formed on the opposite end of the base unit 10 from the front storage area 20 is a rear storage area 23. Like the front storage area 20, the rear storage area 23 may also contain two optional shelves 24. The shelves 24 are supported by shelf supports 25 attached to the inside surfaces of the two vertical side panels 15. A back panel member 37 is also attached to the inside surface of the rear storage area 23.

The top and bottom panels 33, 35 of the base unit 10 extend the full length of the base unit 10 and are supported by two longitudinally aligned top rails 11 and two longitudinally aligned bottom rails 13, respectively. Attached to the upper ends of the two back panels 37 are two top cross rails 12, which help support the middle section of the top panel 33. Located adjacent to each back panel 37 are two vertically aligned shelf supports 25. The shelf supports 25 extend upward from the bottom panel 35 to the top panel 33.

Figure 6:
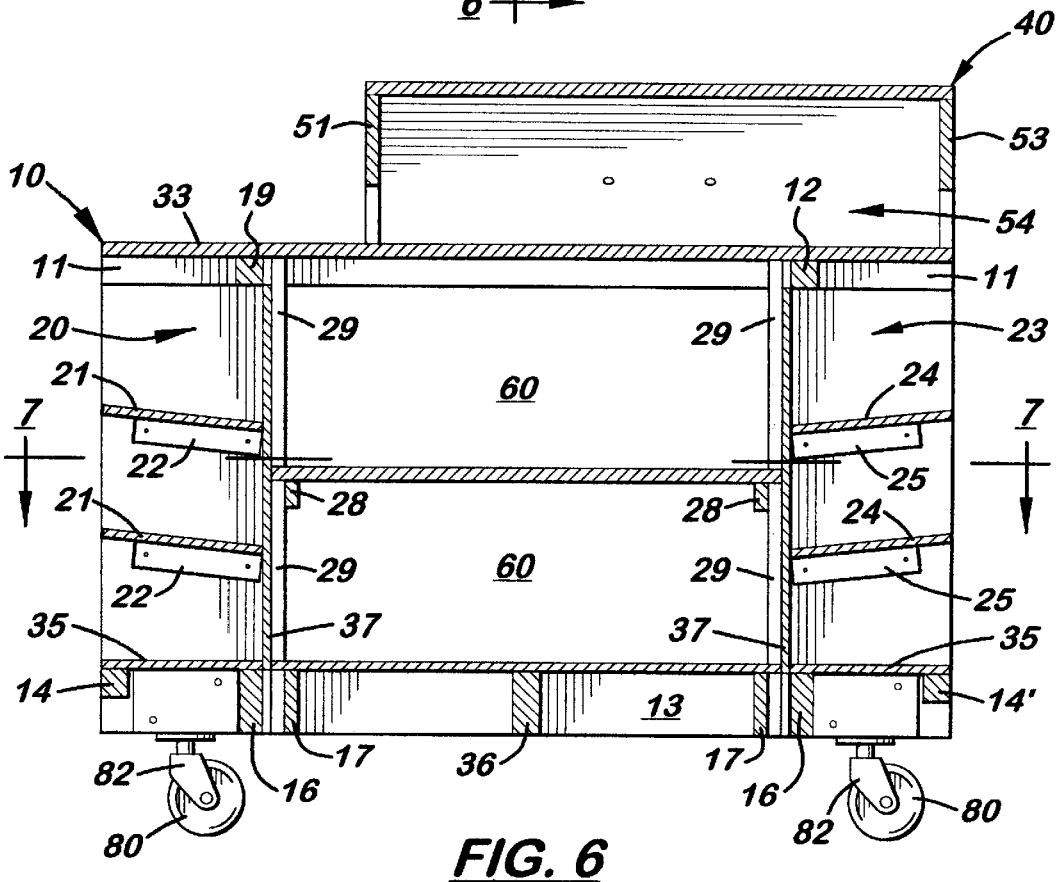
FIG. 6 is a sectional, side elevation view of the transport cart shown along line 6—6 in FIG. 5.
Figure 7:
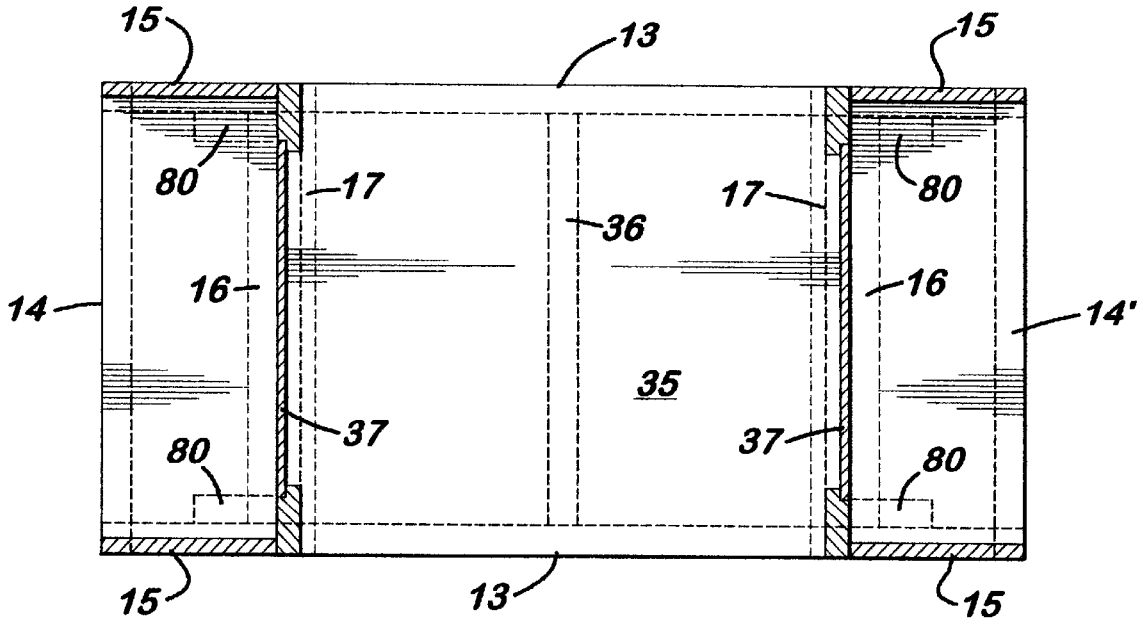
FIG. 7 is a sectional plan view of the transport cart shown along line 7—7 in FIG. 6.

Located on the opposite ends of the two bottom longitudinal rails 13 are two transversely aligned bottom cross rails 14 and 14'. The opposite ends of the cross rails 14, 14' extend across the ends of the adjoining bottom longitudinal rails 13. As shown in FIG. 6, located approximately ¼ the distance of the bottom longitudinal rails 13 are two transversely aligned bottom mid-rails 16. Located centrally between the two bottom longitudinal rails 13 is one transversely aligned bottom cross rail 36. Located between the bottom cross rail 36 and each bottom mid-rails 16 is an optional bottom stringer rail 17.

Formed between the two-end storage areas 20 and 23 is a center storage area 60 that extends transversely across the base unit 10. Disposed inside the central storage area 60 is an optional shelf 27 supported by shelf support members 28 attached to the inside surfaces of vertically aligned shelf supports 29. The opposite ends of the shelf supports 29 are attached to the top and bottom rails 11, and 13, respectively.

The trapezoidal unit 40 includes a flat top surface 42, two diagonally aligned side surfaces 44, 48, and two opposite end openings 52, 54. The top surface 42 may be used to support a large workbench tool, such as a band saw 90. While the two diagonally aligned side surfaces 44, 48 may be used to support a small workbench tool, such as a belt sander 92 or jointer 94. The end openings 52, 54 enable work pieces 98 and elongated tools (not shown) to be stored longitudinally under the trapezoidal unit 40 and over the top surface 19 of the top panel 33. Holes 45 are formed on the side surfaces 44, 48 to hold the workbench tools thereto.

The trapezoidal unit 40 is approximately ⅔ the length of the base unit 10, and is aligned over one end of the base unit 10 to create a flat, horizontal workbench over one end. The width of the trapezoidal unit 40 at the distal ends of the two diagonally aligned side surfaces 44 and 48 is approximately equal to the width of the base unit 10. The diagonally aligned side surfaces 44, 48 are held in position by two horizontally aligned brace members 51 and 53. The brace members 51 and 53 are positioned above the top surface of the top panel 33 of the base unit 10, thereby creating opposite front and rear openings 52, 54 into the trapezoidal unit 40.

The cart 9 includes four caster wheels 80 attached to the corners of the base unit 10. More particularly, the brackets 82 on the caster wheels 80 are attached to the longitudinal members 13 on each side of the base unit 10.

In the preferred embodiment, the base unit 10 measures approximately 48 inches in length, 24 inches in width, and 30 inches in height. The trapezoidal unit 40 measures approximately 33 inches in length, and is approximately 10 inches in height. The width of the top surface 42 and the base of the trapezoidal unit 40 is approximately 12 inches and 24 inches, respectively. The width of each diagonal surface 44 and 48 is approximately 12 inches. The front and rear openings 52, 54 into the trapezoidal unit 40 are approximately 5 inches in height. The components are attached together with standard wood glue and suitable threaded connectors.

In compliance with the statute, the invention has been described herein in language more or less specific as to structural features. It should be understood, however, that the invention is not limited to the specific features shown, since the means and construction shown comprise only the preferred embodiments for putting the invention into effect. The invention is therefore claimed in any of its forms or modifications within the legitimate and valid scope of the amended claims, appropriately interpreted in accordance with the doctrine of equivalents.

I claim:

1. A universal tool transport cart, comprising a. a base unit including at least one end storage area, said base unit including a full extending top panel;

b. a hollow trapezoidal unit longitudinally aligned and disposed over said top panel, said trapezoidal unit including a flat top surface and two diagonally aligned side surfaces, said trapezoidal unit being shorter in length than said base unit thereby enabling said top panel to be exposed and used as a work bench and having at least one end opening formed therein to provide access to the top panel located under said trapezoidal unit;

c. a plurality of caster wheels attached to said base unit enabling said cart to be moved, and;

d. means for attaching a tool to said top surface of said trapezoidal unit.

2. The tool transport cart, as recited in claim 1, further including said trapezoidal unit having two opposite openings formed therein to allow work pieces to be aligned longitudinally over said top panel of said base unit.

3. The tool transport cart, as recited in claim 1, further including a plurality of shelves formed in said end storage area.

4. The tool transport cart, as recited in claim 3, wherein said shelves are upward sloped towards the front.

5. The tool transport cart, as recited in claim 3, further including a second end storage area opposite first said end storage space.

6. The tool transport cart, as recited in claim 5, further including shelves in said second end storage area.

7. The tool transport cart, as recited in claim 1, further including a transversely oriented center storage space formed in said base unit.

8. The tool transport cart, as recited in claim 7, further including a plurality of shelves located inside said center storage space.

9. The tool transport cart, as recited in claim 1, further including means for attaching a tool to at least one said diagonally aligned side surface of said trapezoidal unit.

10. A universal tool transport cart, comprising a. a base unit including two opposite end storage areas and a central storage area, said base unit including a full extending top panel;

b. a hollow trapezoidal unit longitudinally aligned and disposed over said top panel, said unit including a flat top surface, said trapezoidal unit being shorter in length than said base unit thereby enabling said top panel to be exposed and used as a work bench and having at least one end opening formed therein to provide access to the top panel located under said trapezoidal unit, and;

c. a plurality of caster wheels attached to said base unit enabling said cart to be moved.

11. The tool transport cart, as recited in claim 10, further including a plurality of shelves formed in one said end storage area.

12. The tool transport cart, as recited in claim 11, further including a plurality of shelves formed in said other end storage area.

13. The tool transport cart, as recited in claim 10, further including a plurality of shelves formed in said center storage space.

14. The tool transport cart, as recited in claim 10 wherein said trapezoidal unit includes two diagonally aligned side surfaces.

* * * * *